US007442067B1

(12) United States Patent
Amaral

(10) Patent No.: US 7,442,067 B1
(45) Date of Patent: Oct. 28, 2008

(54) ELLIPSOIDS SHAPE CORD CLAMP

(76) Inventor: Jerry N. Amaral, 6032 Stoddard Rd., Oakdale, CA (US) 95361

( * ) Notice: Subject to any disclaimer, the term of this patent is extended or adjusted under 35 U.S.C. 154(b) by 0 days.

(21) Appl. No.: 11/825,534

(22) Filed: Jul. 6, 2007

Related U.S. Application Data

(60) Provisional application No. 60/818,862, filed on Jul. 6, 2006.

(51) Int. Cl.
*H01R 13/62* (2006.01)

(52) U.S. Cl. ..... 439/369; 439/367

(58) Field of Classification Search ..... 439/369, 439/368, 367, 370, 458, 353; D13/156
See application file for complete search history.

(56) References Cited

U.S. PATENT DOCUMENTS 3,048,810 A 8/1962 Steen
3,183,302 A * 5/1965 Wochner et al. ..... 174/138 F
4,143,934 A * 3/1979 Siebert ..... 439/369
4,643,505 A * 2/1987 House et al. ..... 439/369
4,917,625 A 4/1990 Haile
5,217,387 A * 6/1993 Hull et al. ..... 439/367
5,259,782 A * 11/1993 Giffin ..... 439/367
D346,787 S 5/1994 Cullen
5,685,732 A 11/1997 Lane
5,755,588 A * 5/1998 Sweatman et al. ..... 439/369
6,878,007 B1 * 4/2005 Decker ..... 439/369
2006/0035508 A1 * 2/2006 Stekelenburg ..... 439/369

* cited by examiner

*Primary Examiner*—Hae Moon Hyeon

(57) ABSTRACT

A cord clamp includes a football-shaped shell into which a male end of one cord and a female end of a second cord are placed. The clamp, when closed, will maintain these two cords coupled together yet will be easily maneuvered around objects due to its shape.

3 Claims, 3 Drawing Sheets

ELLIPSOIDS SHAPE CORD CLAMP

RELATED APPLICATION

This application claims priority to a U.S. provisional Application Ser. No. 60/818,862, filed Jul. 6, 2006, which is hereby incorporated by reference.

TECHNICAL FIELD OF THE INVENTION

The present invention relates to the general art of cords and cables, and to the particular field of accessories used with cords and cables.

BACKGROUND OF THE INVENTION

Extension cords are commonly used to provide electrical power to portable tools. As the portable tool gets further away from the outlet, a series of mated extension cords are typically employed. By the very nature of this use, the cords are often dragged around and placed under considerable tension, resulting in a disconnection between the last cord and the portable device, a disconnection between two of the cords, or a disconnection between the first cord and the electrical outlet.

The interconnection of several flexible extension cords to transmit power from a source, such as an electrical outlet, to a device is very common. In a household environment, several extension cords may be interconnected to provide power to a device, such as a lawnmower or hedge trimmer for use at a distance from a power outlet. Interconnected extension cords may also be used in commercial applications, particularly by construction workers operating hand tools or other devices operated remotely from a power outlet.

The typical extension cord includes male and female plugs interconnected by a flexible cable. In many extension cords, the female plug of one cord is connected to the male plug of another cord by receiving spade type conductors from the male plug and urging internal conductors in contact therewith. On many occasions, the application of tension to a cable of a connected pair of extension cords will induce separation or disconnection of the conductors in the plugs and prevent the transmission of power. This naturally results in inconvenience and expense caused by the necessity to reconnect the plugs.

Therefore, there is a need for a means for locking one cord to another to avoid this inconvenience.

SUMMARY OF THE INVENTION

These, and other, objects are achieved by a cord clamp that includes a football-shaped shell into which a male end of one cord and a female end of a second cord are placed. The clamp, when closed, will maintain these two cords coupled together yet will be easily maneuvered around objects due to its shape.

BRIEF DESCRIPTION OF THE DRAWING FIGURES

DETAILED DESCRIPTION OF THE PREFERRED EMBODIMENT OF THE INVENTION

Figure 1:
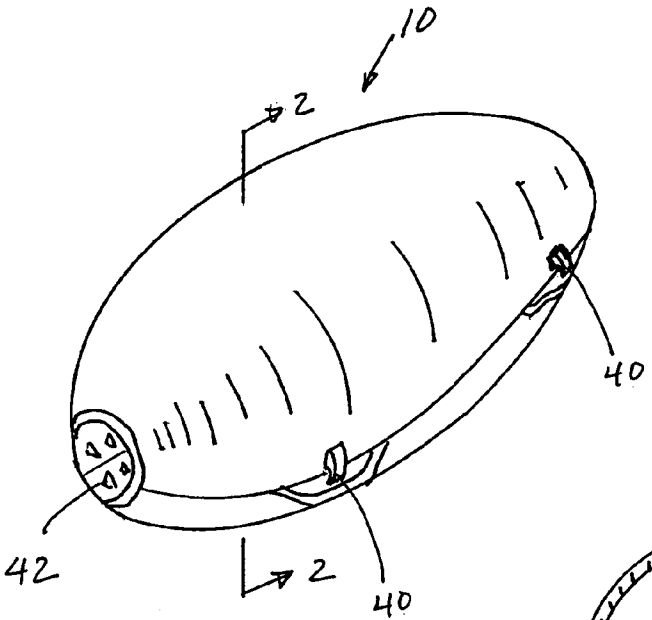
FIG. 1 is a perspective view of a cord clamp embodying the present invention in a closed condition.

Referring to the figures, it can be understood that the present invention is embodied in a clamp unit 10 that includes a first shell 12 and a second shell 14. The two shells 12 and 14 are hinged together by hinge unit 16 to move between an open position shown in FIG. 4 and a closed position shown in FIG. 1. FIG. 5 shows that the two shells 12 and 14 are adapted to receive two cords 18 and 20 in a locked condition with a male element 22 locked to a female element 24. The two shells 12 and 14 may have prolate ellipsoids like configuration to form a football-shaped as shown in FIG. 1.

Figure 3:
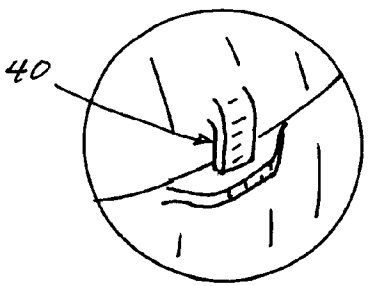
FIG. 3 is a view of detail A in FIG. 1.
Figure 2:
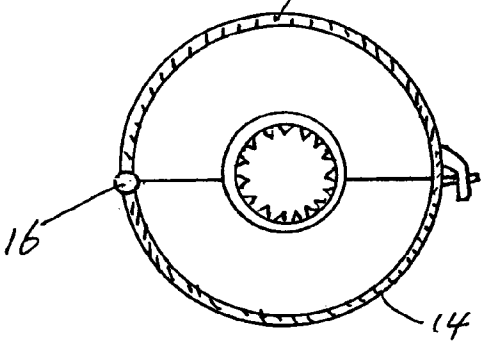
FIG. 2 is a sectional view taken along line 2-2 of FIG. 1.

FIG. 2 shows that the clamp unit 10 may have one or more lock elements 40 to hold the two shells 12 and 14 in the closed position. FIG. 3 shows an enlarge view of the lock elements 40.

Figure 4:
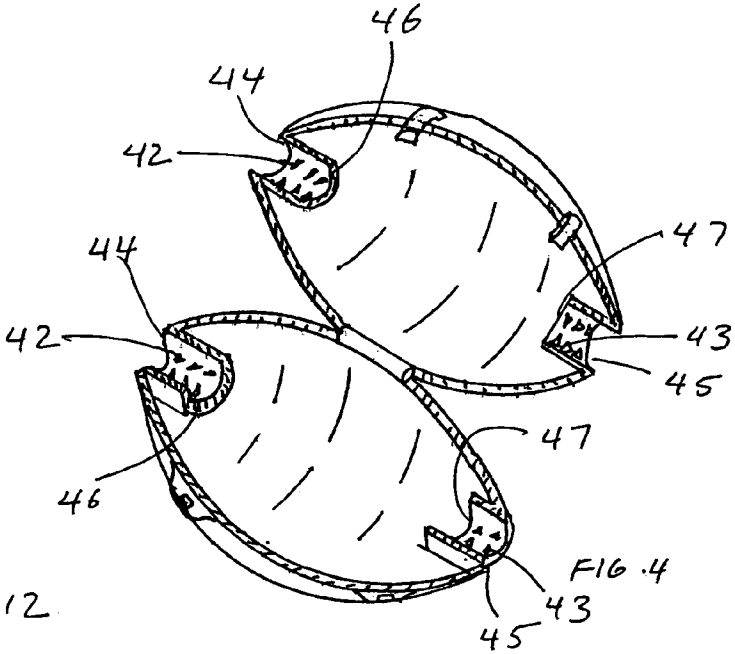
FIG. 4 is a perspective view of a cord clamp embodying the present invention in an open condition.
Figure 5:
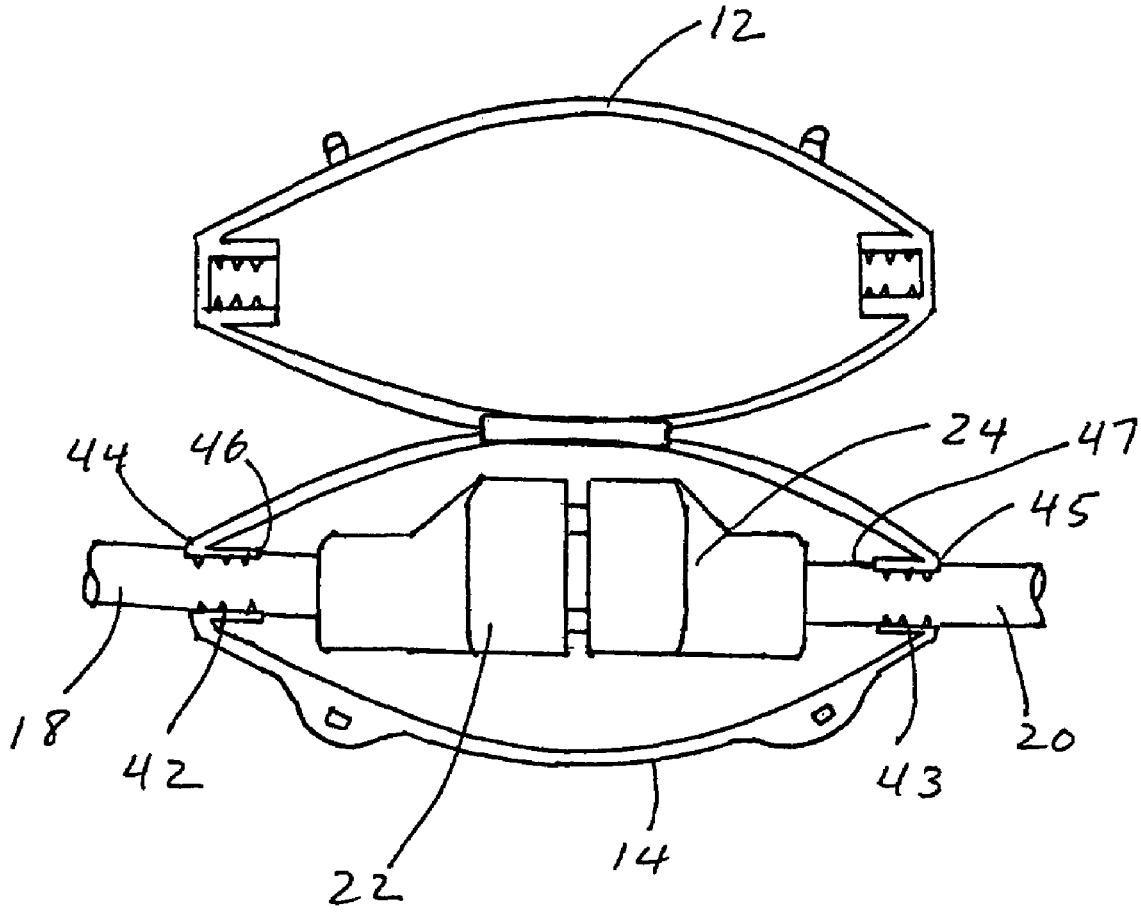
FIG. 5 shows the clamp with two cords accommodated therein.

FIG. 4 shows that the cords extend through cylindrical sleeves 42 and 43. The cylindrical sleeves 42 and 43 may have a plurality of protrusions to bit into their respective cords 18 and 20. As such, when the clamp unit 10 is in the closed position, the male and female elements 22 and 24 remain in the locked condition even when the two cords 18 and 20 are pulled from each other. The sleeve 42 has a length defined by the outer end 44 and the inner end 46, and the sleeve 43 has length defined by the outer end 45 and inner end 47.

Figure 6:
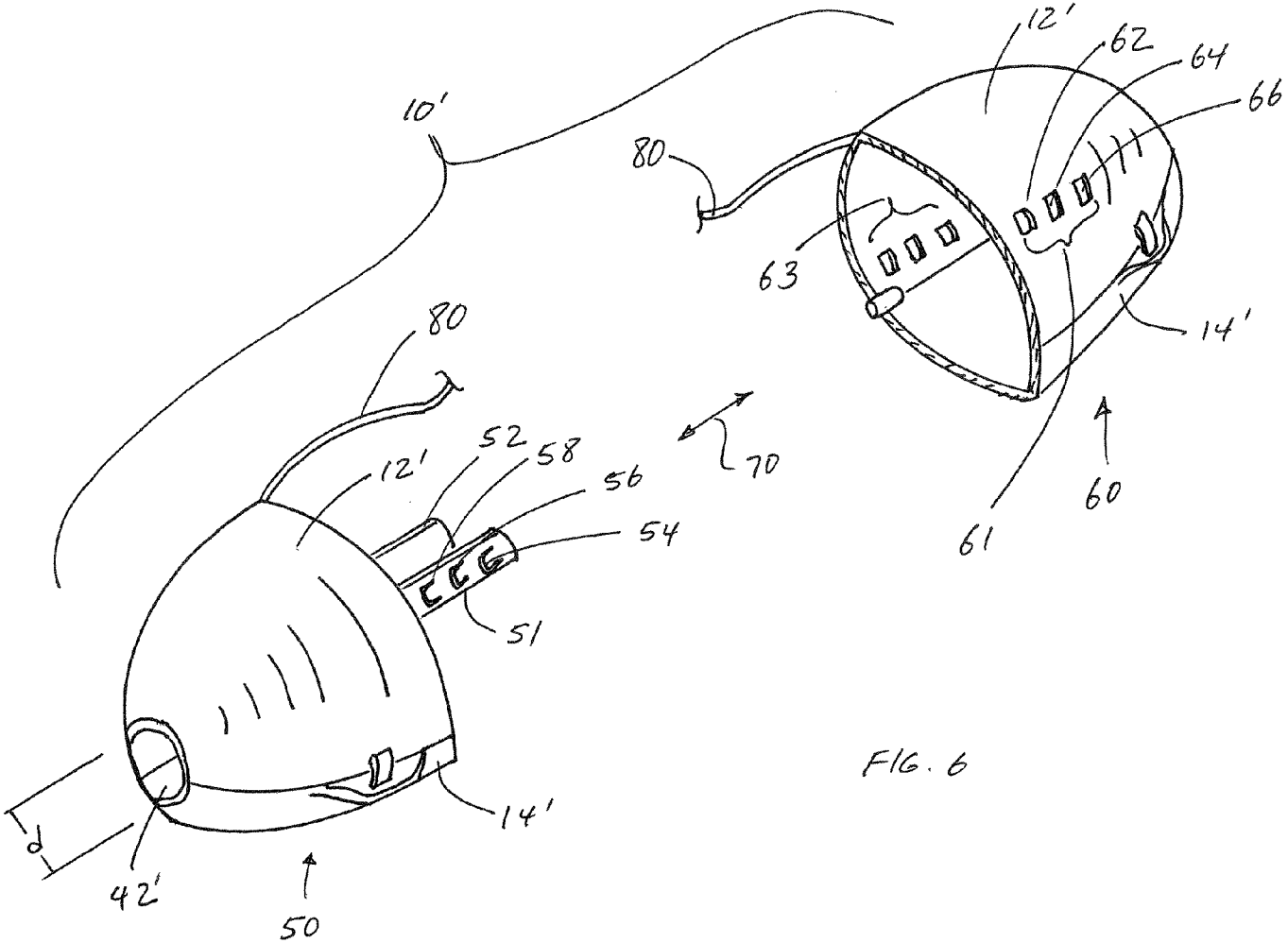
FIG. 6 shows a perspective view of an alternative cord clamp.

FIG. 6 shows an alternative clamp 10' where its length may be adjusted to accommodate different sizes of male and female elements 22 and 24. The clamp 10' includes the two shells 12' and 14', which are divided into a first portion 50 and a second portion 60. The first portion 50 may have a first extension 51 and a second extension 52. Each of the extensions 51 and 52 may have a first tooth 54, a second tooth 56, and a third tooth 58, along their respective longitudinal axes 70. The second portion 60 may have a first set of holes 61 and a second set of holes 63 to match the teeth formed on the first and second extensions 51 and 52. For instance, the first set of holes 61 includes the first hole 62, a second hole 64, and a third hole 66 along the longitudinal axis 70. The diameter "d" of the sleeves 42' in the first and second portions 50 and 60 may be greater than the diameter of the sleeve 42 to accommodate larger diameter size cords 18 and 20. The first and second portions 50 and 60 may be tied together through a string 80.

The extensions 51 and 52 on the first portion 50 and the set of corresponding holes on the second portion 60 allow the length of the clamp 10' to be adjusted along the longitudinal axis 70 to accommodate different sizes of male and female elements 22 and 24. For instance, when the first tooth 54 engages with the first hole 62, then the length of the cord clamp 10 is at its longest length, and when the first tooth 54 engages with the third hole 66, then the length of the cord clamp is at its shortest distance. Note that when the first tooth 54 engages with the third hole 66, then the second tooth 56 engages with the second hole 64 and the third tooth 58 engages with the first hole 62.

In use, the male and female elements 22 and 24 may be placed inside the first and second portions 50 and 60, respectively. The two shells 12' and 14' may be closed over their respective elements 22 and 24 and locked in the closed position through the lock elements 40. The first and second portions 50 and 60 may be pushed against each other while aligning the extensions 51 and 52 with their respective set of holes 61 and 63 such that the first tooth 54 engages with the one of the holes 62, 64, and 66 until the inner ends 46 of the sleeve 42' pushes against the male element 22, and the inner end 47 of the sleeve 43 pushes against the female element 24. Depending on the size of the male and female elements 22 and 24, the first tooth 54 may engage with the first hole 62, the second hole 64, or the third hole 66 to lock the male and female elements 22 and 24 within the clamp unit until the two portions 50 and 60 are released from each other by pushing against the teeth engaged with the holes.

It is understood that while certain forms of the present invention have been illustrated and described herein, it is not to be limited to the specific forms or arrangements of parts described and shown.

What is claimed is:

1. A clamp adapted to hold a male plug and a female plug together, the clamp comprising:

a first shell having a first sleeve, the first sleeve having a first inner end and a first outer end, where the circumference of the first sleeve is adapted to receive a first cord;

a second shell having a second sleeve, the second sleeve having a second inner end and a second outer end, where the circumference of the second sleeve is adapted to receive a second cord and the first and second sleeves are formed along a longitudinal axis; and a hinge unit pivotally coupling the first and second shells together to move between an open position and a closed position, in the closed position, the first and second shell form a prolate ellipsoids shape and adapted to receive the male plug element and the female plug element, and the first and second shells are adapted to lock in the closed position, the first and second shells divided into a first portion and a second portion, the first portion having at least one extensions along the longitudinal axis and the each extension having a plurality of teeth, the second portion having at least one set of holes aligned with the plurality of teeth along the longitudinal axis and adapted to engage with at least one of the teeth so that the first and second portions can be locked with respect the each other with an adjustable distance between the first inner end and the second inner end, where the first and second portions are released from each other by pushing on at least one of the teeth through the hole that the at least one of the teeth is engaged therewith.

2. The clamp according to claim 1, where the first and second sleeves includes a plurality of protrusions adapted to engage with their respective cords to hold the male and female plugs within the clamp in the closed position.

3. The clamp according to claim 1, including a string to tie the first and second portions together.

* * * * *